US006408825B1

(12) United States Patent
Enoki et al.

(10) Patent No.: US 6,408,825 B1
(45) Date of Patent: Jun. 25, 2002

(54) FUEL INJECTION CONTROL APPARATUS FOR INTERNAL COMBUSTION ENGINE

(75) Inventors: Keiichi Enoki; Tadahiro Azuma, both of Tokyo; Takeshi Kakigi, Hyogo, all of (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/985,854

(22) Filed: Nov. 6, 2001

(30) Foreign Application Priority Data

Apr. 19, 2001 (JP) ..... 13-120996

(51) Int. Cl.[7] ..... F02M 41/00
(52) U.S. Cl. ..... 123/467; 123/179.17; 123/456
(58) Field of Search ..... 123/516, 458, 123/179.17, 198 D, 506, 456, 467

(56) References Cited

U.S. PATENT DOCUMENTS 5,074,272 A * 12/1991 Bostick et al. ..... 123/514
5,558,068 A * 9/1996 Kunishima et al. ..... 123/516
5,598,817 A * 2/1997 Igarashi et al. ..... 123/179.17
5,626,121 A * 5/1997 Kushida et al. ..... 123/514
5,911,208 A * 6/1999 Furusawa et al. ..... 123/506
6,021,763 A * 2/2000 Yoshihara et al. ..... 123/516
6,058,912 A * 5/2000 Rembold et al. ..... 123/516

FOREIGN PATENT DOCUMENTS

JP 6-108943 4/1994 ..... F02M/37/00
JP 9-42109 2/1997 ..... F02M/51/02

* cited by examiner

*Primary Examiner*—Carl S. Miller
(74) *Attorney, Agent, or Firm*—Sughrue Mion, PLLC

(57) ABSTRACT

In an internal combustion engine system, a fuel injection control apparatus for preventing fuel leakage with high reliability in the engine-stopped state. The apparatus includes various types of sensors (5, 6, 14, 15) for detecting operation states of an internal combustion engine (1), a fuel pump (24) and a fuel supply pipe (22) for supplying a fuel from a fuel tank (23) to the engine (1), a fuel injector (8) for injecting the fuel into the engine, an engine stoppage detecting means for detecting a stopped state of the engine (1), a fuel temperature estimating means for estimating temperature of the fuel within the fuel supply pipe (22), and a fuel pressure lowering means for lowering pressure of the fuel within the fuel supply pipe (22). The fuel pressure lowering means is designed to lower pressure of the fuel within the fuel supply pipe (22) after the stoppage of operation of the engine (1) in dependence on an estimated fuel temperature determined by the fuel temperature estimating means.

6 Claims, 7 Drawing Sheets

FUEL INJECTION CONTROL APPARATUS FOR INTERNAL COMBUSTION ENGINE

BACKGROUND OF THE INVENTION

1. Field of the Invention

The present invention relates to a fuel injection control apparatus for an internal combustion engine which apparatus is capable of suppressing or preventing fuel leakage from a fuel injector in the state where the engine is stopped and which can be implemented without incurring any appreciable increase in the cost as compared with existing apparatuses.

2. Description of Related Art

In general, in the internal combustion engine (hereinafter also referred to simply as the engine) for automobiles or motor vehicles, fuel is supplied to the engine from a fuel tank by way of a fuel pump and a fuel supply pipe to be thereby injected into engine cylinder(s) through a fuel injector.

In such fuel injection system as mentioned above, vaporization of the fuel within the fuel supply pipe has to be suppressed or prevented in order to ensure high restarting performance of the engine from the state where a high temperature prevails.

To this end, in the hitherto known or conventional fuel injection control apparatus for the engine, a check valve is provided at the side of a discharge port of the fuel pump so that a high fuel pressure can be held within the fuel supply pipe by preventing the residual fuel pressure within the fuel supply pipe from lowering in the engine stoppage state (i.e., in the state where the engine operation is stopped).

However, when the fuel pressure within the fuel supply pipe continues to be held at a high level in the engine stoppage state, there may arise such unwanted situation that the fuel leaks into the intake pipe of the engine from the fuel injector.

FIG. 5 of the accompanying drawings is a view for graphically illustrating change of the fuel pressure [MPa] within the fuel supply pipe as a function of time lapse [min] in the engine stoppage state, wherein curve (a) represents the fuel pressure change in the conventional apparatus.

As can be seen from the curve (a) shown in FIG. 5, the fuel pressure held at a high level just after the stoppage of the engine operation lowers to a level equivalent to the atmospheric pressure (=0.1 [MPa]) within about 60 minutes. In that case, the quantity of gasoline or fuel leakage will amount to ca. 20 mcc per fuel pipe line.

The fuel leakage mentioned above provides a cause for increasing the amount of unburnt hydrocarbon (harmful gas) contained in the exhaust gas discharged in the succeeding engine starting operation (i.e., engine restarting operation).

FIG. 6 of the accompanying drawings is a view for graphically illustrating change of the concentration [ppm] of total hydrocarbon (THC) as a function of time [sec] in the engine starting operation, wherein a curve (a) represents the change of the THC concentration in the conventional apparatus.

As can be seen from the curve (a) shown in FIG. 6, the discharge quantity of hydrocarbon (HC) in the engine starting operation is very large initially for a time of about one second. Furthermore, since the quantity of fuel leakage from the fuel injector can not be controlled, it provides a cause for dispersion or variance of the exhaust gas components in the engine starting operation.

Besides, the fuel leaked into the intake pipe will increase the volume of fuel vapor gases emanated from the motor vehicle. At this juncture, it should be added that the exhaust gas condition in the conventional apparatus is going beyond the permissible level in the light of the statutory exhaust gas regulations which have become more severe in recent years.

Under the circumstances, there have been proposed various fuel injection control apparatuses for the internal combustion engines which tackle with the problems mentioned above.

By way of example, in the fuel injection control apparatus disclosed in Japanese Unexamined Patent Application Publication No. 108943/1994 (JP-A-6-108943), the fuel leakage from the fuel injector is suppressed by lowering the fuel pressure within the fuel supply pipe by opening a bypass valve which allows the fuel to return to the fuel tank when the engine is stopped.

Further, in the fuel injection control apparatus disclosed in Japanese Unexamined Patent Application Publication No. 42109/1997 (JP-A-9-42109), the fuel temperature and the fuel pressure are detected for thereby controlling a bypass valve such that a desired fuel pressure can be established within the fuel supply pipe in dependence on the fuel temperature in an effort to prevent or suppress the fuel leakage from the fuel injector while enhancing the engine restarting performance in a high temperature engine state.

In the case of the first mentioned conventional apparatus (described in JP-A-6-108943), such arrangement is adopted that the fuel is fed to the fuel supply pipe from the fuel tank when the bypass valve is closed upon starting of the engine operation (i.e., upon closing of an ignition switch).

Thus, the conventional apparatus mentioned above suffers a problem that in case the bypass valve should get out of order, there may undesirably arise such situation that the fuel can not be fed to the engine upon starting of the engine operation. Besides, when the fuel temperature is high, the fuel will return to the fuel tank incurring thus degradation in the high-temperature engine restarting performance, to another disadvantage.

On the other hand, in the case of the second-mentioned conventional apparatus (described in JP-A-9-42109), it is required to additionally provide a fuel temperature sensor and a fuel pressure sensor, which means that the cost involved in the implementation of the apparatus increases, giving rise to another problem.

As is apparent from the foregoing, the conventional fuel injection control apparatus such as described in JP-A-6-108943 suffers problems that the fuel can not be fed out when the bypass valve gets out of order and that the engine restarting performance becomes degraded when the fuel temperature is high.

Besides, the conventional fuel injection control apparatus such as described in JP-A-9-42109 is disadvantageous in that the fuel temperature sensor and the fuel pressure sensor are additionally required, incurring increase of the cost.

SUMMARY OF THE INVENTION

In the light of the state of the art described above, it is an object of the present invention to provide a fuel injection control apparatus for an internal combustion engine which can solve the problems mentioned above and which is capable of preventing or suppressing positively the fuel leakage from the fuel injector in the engine stoppage state by controlling the bypass valve on the basis of an estimated fuel temperature while rendering it unnecessary to provide additional sensors such as the fuel temperature sensor and the fuel pressure sensor.

In view of the above and other objects which will become apparent as the description proceeds, there is provided according to a general aspect of the present invention a fuel injection control apparatus for an internal combustion engine, which apparatus includes various types of sensors for detecting operation states of an internal combustion engine, a fuel pump and a fuel supply pipe for supplying a fuel from a fuel tank to the internal combustion engine, a fuel injector for injecting the fuel into the engine, an engine stoppage detecting means for detecting a stopped state of the engine, a fuel temperature estimating means for estimating temperature of the fuel within the fuel supply pipe, and a fuel pressure lowering means for lowering the pressure of the fuel within the fuel supply pipe, wherein the fuel pressure lowering means is designed to lower the pressure of the fuel within the fuel supply pipe after the stoppage of operation of the engine in dependence on an estimated fuel temperature determined by the fuel temperature estimating means.

By virtue of the arrangement of the fuel injection control apparatus described above, the fuel leakage from the fuel injector can positively be prevented in the state where the engine operation is stopped.

In a preferred mode for carrying out the present invention, the various types of sensors may include an intake air temperature sensor for detecting the temperature of an intake air of the engine, and the fuel temperature estimating means may be so designed as to estimate the temperature of the fuel on the basis of the temperature of the intake air.

With the arrangement of the fuel injection control apparatus described above, the estimated fuel temperature can arithmetically be determined with high accuracy and reliability without need for providing any additional sensor advantageously from the standpoint of the cost.

In another preferred mode for carrying out the present invention, the fuel supply pipe may include a bypass valve capable of regulating the pressure of the fuel, and the fuel pressure lowering means may be so designed as to compare the estimated fuel temperature value with a predetermined value to thereby open the bypass valve over a predetermined time period when the estimated fuel temperature value is greater than the predetermined value inclusive.

Owing to the arrangement of the fuel injection control apparatus described above, the fuel leakage from the fuel injector can positively be prevented in the state where the engine is stopped.

In yet another preferred mode for carrying out the present invention, the predetermined value mentioned above may be so set that substantially no inconvenience can take place upon restarting of operation of the internal combustion engine from a high temperature state thereof.

With the arrangement described above, the fuel leakage from the fuel injector can positively be prevented without incurring any problem upon restarting of the engine from the high-temperature state thereof.

In still another preferred mode for carrying out the present invention, the fuel injection control apparatus for an internal combustion engine which is equipped with starter for starting operation of the engine may further include a starter control means for controlling driving operation of the starter, wherein the starter control means is so designed as to drive the starter upon lapse of a predetermined delay time since a time point at which operation of the fuel pump has been started upon engine starting operation in a state where the fuel pressure has been lowered by the fuel pressure lowering means.

With the arrangement of the fuel injection control apparatus described above, generation of fuel vapor upon fuel injection in the engine starting operation can be suppressed, to further advantage.

In a further preferred mode for carrying out the present invention, the delay time mentioned above may be set to a time required for the pressure of the fuel to increase sufficiently since the time point at which the operation of the engine has been started.

Owing to the arrangement of the fuel injection control apparatus described above, engine operation can be started upon initial fuel injection with high reliability.

The above and other objects, features and attendant advantages of the present invention will more easily be understood by reading the following description of the preferred embodiments thereof taken, only by way of example, in conjunction with the accompanying drawings.

BRIEF DESCRIPTION OF THE DRAWINGS

In the course of the description which follows, reference is made to the drawings, in which.

DESCRIPTION OF THE PREFERRED EMBODIMENTS

Figure 1:
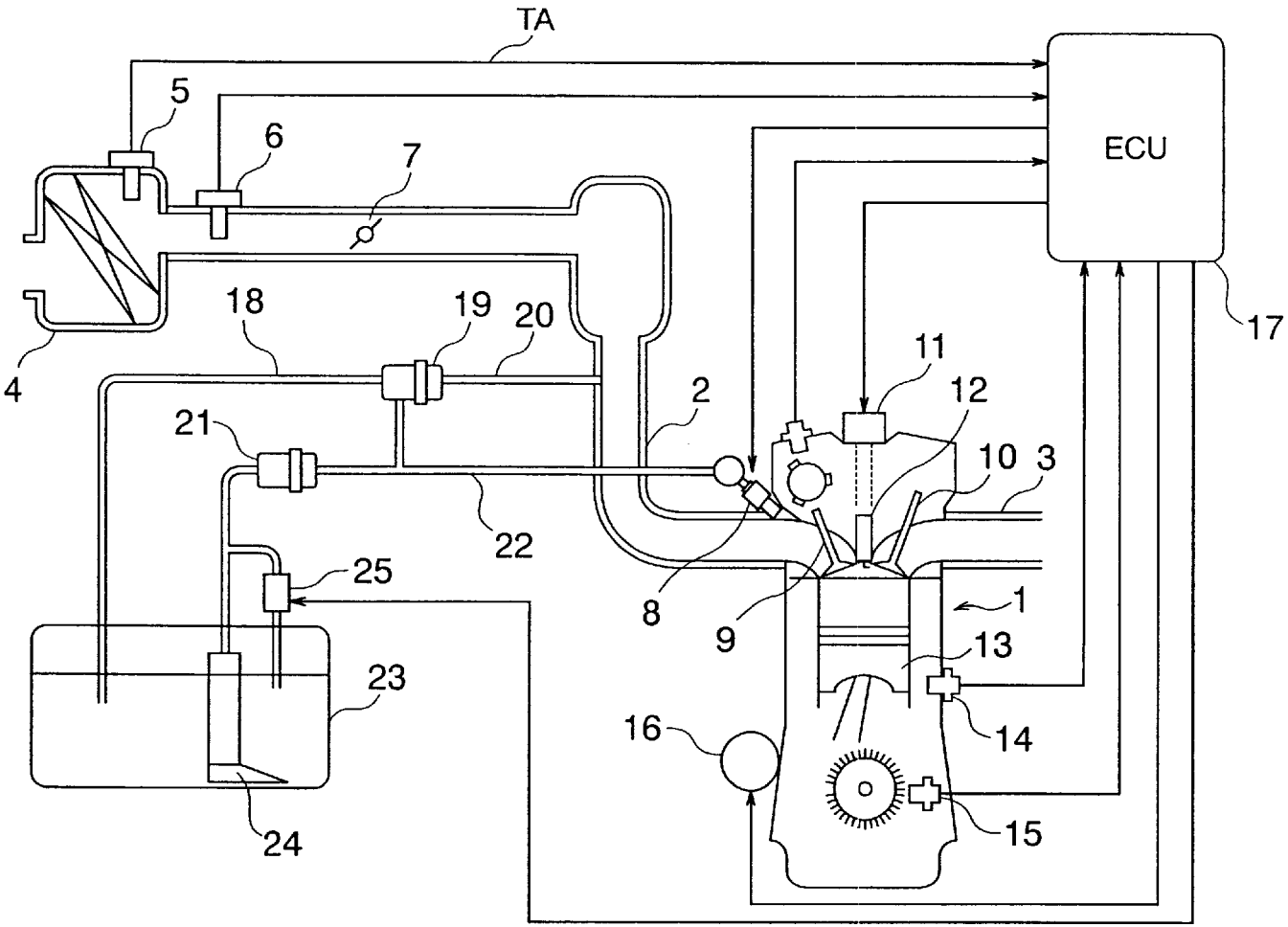
FIG. 1 is a view showing generally and schematically a configuration of an internal combustion engine system equipped with a fuel injection control apparatus according to a first embodiment of the present invention.

The present invention will be described in detail in conjunction with what is presently considered as preferred or typical embodiments thereof by reference to the drawings. In the following description, like reference characters designate like or corresponding parts throughout the several views.

Embodiment 1

FIG. 1 is a view showing generally and schematically a configuration of an internal combustion engine system equipped with a fuel injection control apparatus according to a first embodiment of the present invention.

Referring to FIG. 1, the internal combustion engine generally denoted by reference numeral 1 is provided with an intake pipe 2 for feeding intake air to the engine and an exhaust pipe 3 for discharging an exhaust gas resulting from combustion of the air-fuel mixture in the engine cylinder(s).

The intake pipe 2 is equipped with an air filter 4, an intake-air temperature sensor 5, an air-flow sensor 6, a throttle valve 7 and a fuel injector 8 disposed in this order as viewed from the upstream side.

The intake-air temperature sensor 5 serves for detecting the temperature of the intake air while the air-flow sensor 6 is designed to provide information concerning the amount or quantity of the intake air fed to the engine 1. On the other hand, the throttle valve 7 serves for adjusting or regulating the intake air quantity fed or supplied to the engine 1. The fuel injector 8 injects a fuel at a location upstream of the engine 1.

An electronic control unit (hereinafter also referred to as the ECU in abbreviation) 17 which is in charge of controlling the engine system may be implemented as a microprocessor or microcomputer which is so programmed as to arithmetically determine various control parameters employed for the combustion control in the engine 1 on the basis of detection information (information of the operation states of the engine 1) derived from the output signals of the various sensors, to thereby output driving signals in conformance with the control parameters.

An intake valve 9 and an exhaust valve 10 are installed at communication ports, respectively, through which combustion chamber of the engine is communicated to the intake pipe 2 and the exhaust pipe 3, respectively. The engine 1 is provided with an ignition coil 11 and a spark plug 12 on a cylinder-by-cylinder basis.

The ignition coil 11 applies an igniting discharge voltage to the spark plug 12 under the control of the ECU 17, as a result of a which discharge spark is produced within the combustion chamber in the cylinder. Disposed within the combustion chamber of the engine 1 is a piston 13 which is driven upon combustion of the air-fuel mixture and which is operatively connected to a crank shaft.

A water temperature sensor 14 is mounted on a side wall of the engine 1 for detecting the temperature of the engine cooling water. Further, a crank angle sensor 15 is mounted on the crank shaft of the engine 1 for outputting a crank angle signal indicating the crank angle. More specifically, the crank angle sensor 15 is so designed as to output the crank angle signal in the form of pulse signals representing rotation information of the engine 1 and functions as a rotation sensor as well, as known in the art. The pulses contained in the crank angle signal have edges corresponding to the reference crank angles of the individual engine cylinders, respectively. The reference crank angles are used for arithmetic determination of the control timing for the engine 1.

Disposed in the vicinity of the crank shaft is a starter 16 which is adapted to be operatively coupled to the crank shaft of the engine 1 in response to manipulation of an ignition switch (not shown) upon starting of the engine 1 and driven under the control of the ECU 17.

The intake pipe 2 is communicated to a fuel tank 23 by way of a return pipe 18, a pressure regulator 19 and a connecting rubber pipe 20.

On the other hand, the fuel injector 8 is communicated to the fuel tank 23 by way of a fuel pump 24, a fuel filter 21 and a fuel supply pipe 22, wherein the fuel supply pipe 22 is branched to the pressure regulator 19.

The fuel injector 8 is driven (i.e., opened and closed) under the control of the ECU 17 to charge into the engine 1 the fuel supplied from the fuel tank 23 by way of the fuel pump 24 and the fuel supply pipe 22. Disposed between the discharge port of the fuel pump 24 and the fuel tank 23 is a bypass valve 25 which is operated under the control of the ECU 17.

The ECU 17 includes an engine stoppage detecting means for detecting the stopped state of the engine 1 on the basis of the various sensor information mentioned hereinbefore, a fuel temperature estimating means for estimating the temperature of the fuel within the fuel supply pipe 22, a fuel pressure lowering means for reducing or lowering the pressure of the fuel within the fuel supply pipe 22 by controlling the bypass valve 25, and a starter control means for controlling the starter 16.

In the ECU 17, the fuel temperature estimating means estimates the temperature of the fuel (i.e., fuel temperature) within the fuel supply pipe 22 on the basis of the temperature of the intake air (i.e., intake air temperature) detected by the intake-air temperature sensor 5, while the fuel pressure lowering means lowers or reduces the pressure of the fuel (i.e., fuel pressure) within the fuel supply pipe 22 after the stoppage of the engine 1 in dependence on the estimated value of the fuel temperature (i.e., estimated fuel temperature) as determined by the fuel temperature estimating means.

Next, operation of the fuel injection control apparatus according to first embodiment of the present invention will be described by reference to FIG. 2 which is a flow chart for illustrating a fuel pressure lowering control processing which is executed after the stoppage of the engine (i.e., engine stop).

At first, in a step S1, the ECU 17 makes decision as to whether or not the ignition switch is off or opened (indicating that the engine is in the stopped state). When it is decided that the ignition switch is on or closed (i.e., when the decision step S1 results in negation "NO"), execution of the processing is immediately terminated (RETURN).

On the other hand, when it is decided in the step S1 that the ignition switch is opened or off (i.e., when the decision step S1 results in affirmation "YES"), the intake-air temperature TA is fetched from the output of the air-flow sensor 6 (step S2), whereon the estimated fuel temperature value TF is arithmetically determined as a function f(TA) of the intake-air temperature TA (step S3).

Usually, since the fuel temperature bears a correlation to the temperature prevailing within the engine room (see FIG. 3), the estimated fuel temperature TF can arithmetically be determined on the basis of the intake-air temperature TA. In other words, the estimated fuel temperature TF can be determined without need for additionally providing the fuel temperature sensor and the fuel pressure sensor for the purpose of controlling the bypass valve 25.

Subsequently, the estimated fuel temperature TF is compared with a predetermined value TFo to decide whether the estimated fuel temperature value TF is higher than the predetermined TFo (step S4). In that case, the predetermined value TFo may be stored in advance in the ECU 17. This predetermined value TFo is so selected that so long as the estimated fuel temperature TF is lower than the predetermined value TFo inclusive, no problem or inconvenience arises in restarting the engine from a high-temperature state thereof.

Figure 2:
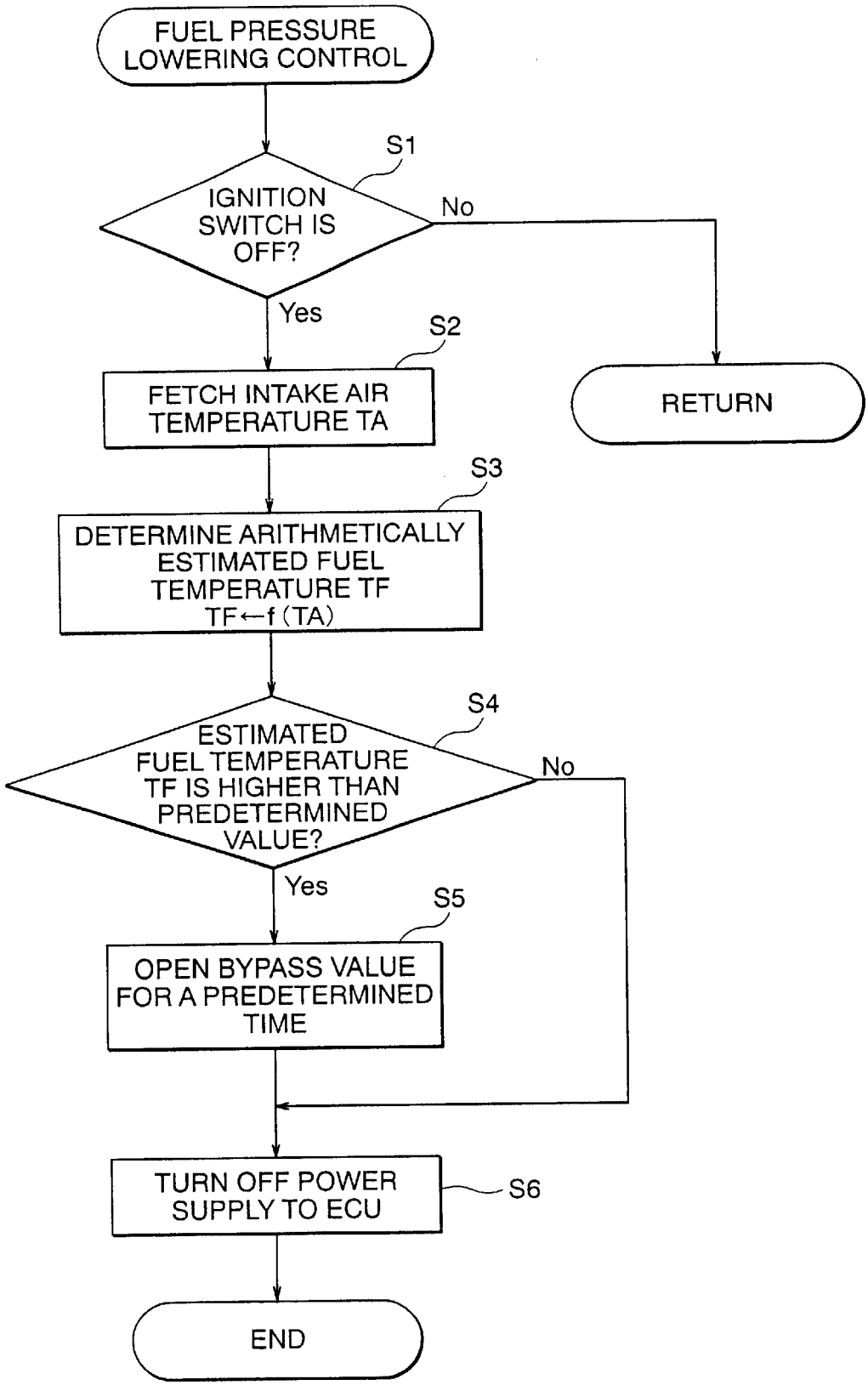
FIG. 2 is a flow chart for illustrating a fuel pressure lowering control operation carried out by the fuel injection control apparatus according to the first embodiment of the present invention.

When it is decided in the step S4 that TF>TFo (i.e., when the decision step S4 results in "YES"), the bypass valve 25 is opened for a predetermined time (step S5) to thereby lower or reduce the fuel pressure, whereon the power supply to the ECU 17 is interrupted (i.e., turned off) in a step S6, and thus the processing routine shown in FIG. 2 comes to an end.

On the other hand, when it is decided in the step S4 that TF≦TFo (i.e., when the decision step S4 results in "NO"), then the power supply to the ECU 17 is immediately interrupted in the step S6 without executing the step S5, and then the processing routine shown in FIG. 2 comes to an end.

Figure 3:
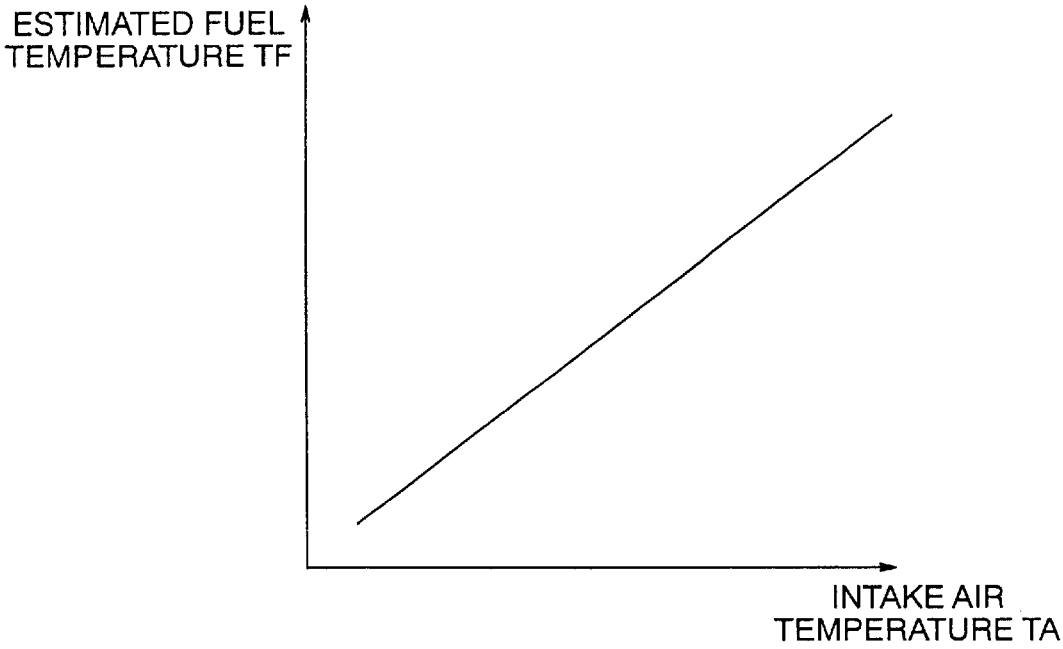
FIG. 3 is a view for graphically illustrating a characteristic relation between an intake-air temperature and an estimated fuel temperature which is referenced when an estimated fuel temperature is arithmetically determined in the fuel injection control apparatus according to the first embodiment of the present invention.

Next, referring to FIGS. 3 to 6, action and effect of the fuel injection control apparatus according to the first embodiment of the invention will be described in more concrete. FIG. 3 is a view for illustrating a characteristic relation between the intake-air temperature TA and the estimated fuel temperature TF. As can be seen in FIG. 3, the estimated fuel temperature TF bears such a relation to the intake-air temperature TA which can be given by an approximately linear function.

The characteristic illustrated in FIG. 3 is previously stored in the ECU 17 in the form of map data which is referenced in the step S3 mentioned above. In this manner, the estimated fuel temperature TF can arithmetically be determined definitely as a function of the intake-air temperature TA.

Figure 4:
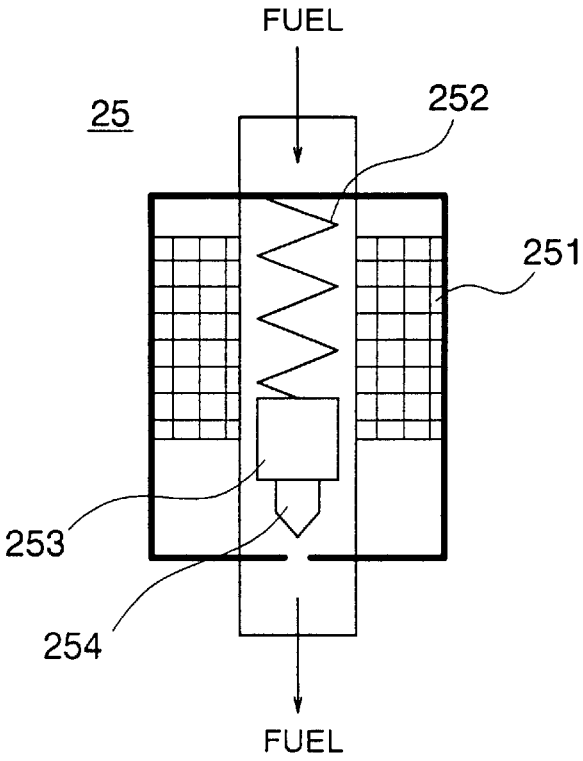
FIG. 4 is a sectional view showing a structure of a bypass valve controlled by the fuel injection control apparatus according to the first embodiment of the present invention.

FIG. 4 is a sectional view showing a structure of the bypass valve 25.

Referring to the figure, the bypass valve 25 includes a spring 252 disposed within a space enclosed by a solenoid 251, a core 253 disposed at a tip end of the spring 252 and driven by the solenoid 251, and a needle valve 254 mounted on a tip end of the core 253.

The spring 252 resiliently urges the needle valve 254 in the tip end direction.

The solenoid 251 is electrically energized in response to a driving signal issued by the ECU 17 in the step S5 shown in FIG. 2. When electrically energized, the solenoid 251 drives the needle valve 254 in the opening direction against the spring force exerted by the spring 252.

So long as the solenoid 251 is not electrically energized, the fuel passage is closed by means of the needle valve 254. Accordingly, the fuel can not return to the fuel tank.

On the other hand, when the solenoid 251 is electrically energized, the fuel flows through the bypass valve 25 in the direction from the rear end of the spring 252 toward the tip end of the needle valve 254 to return to the fuel tank 23.

Thus, the fuel pressure within the fuel supply pipe 22 is lowered.

Figure 5:
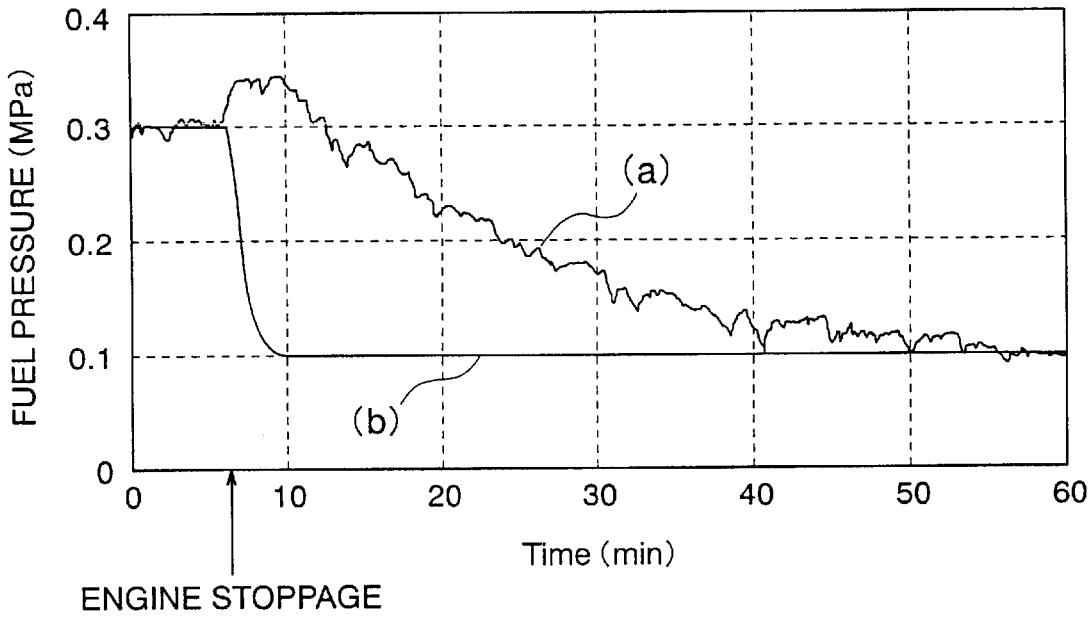
FIG. 5 is a view for graphically illustrating change of a fuel pressure as a function of time lapse in an internal combustion engine equipped with the fuel injection control apparatus according to the first embodiment of the invention.
Figure 6:
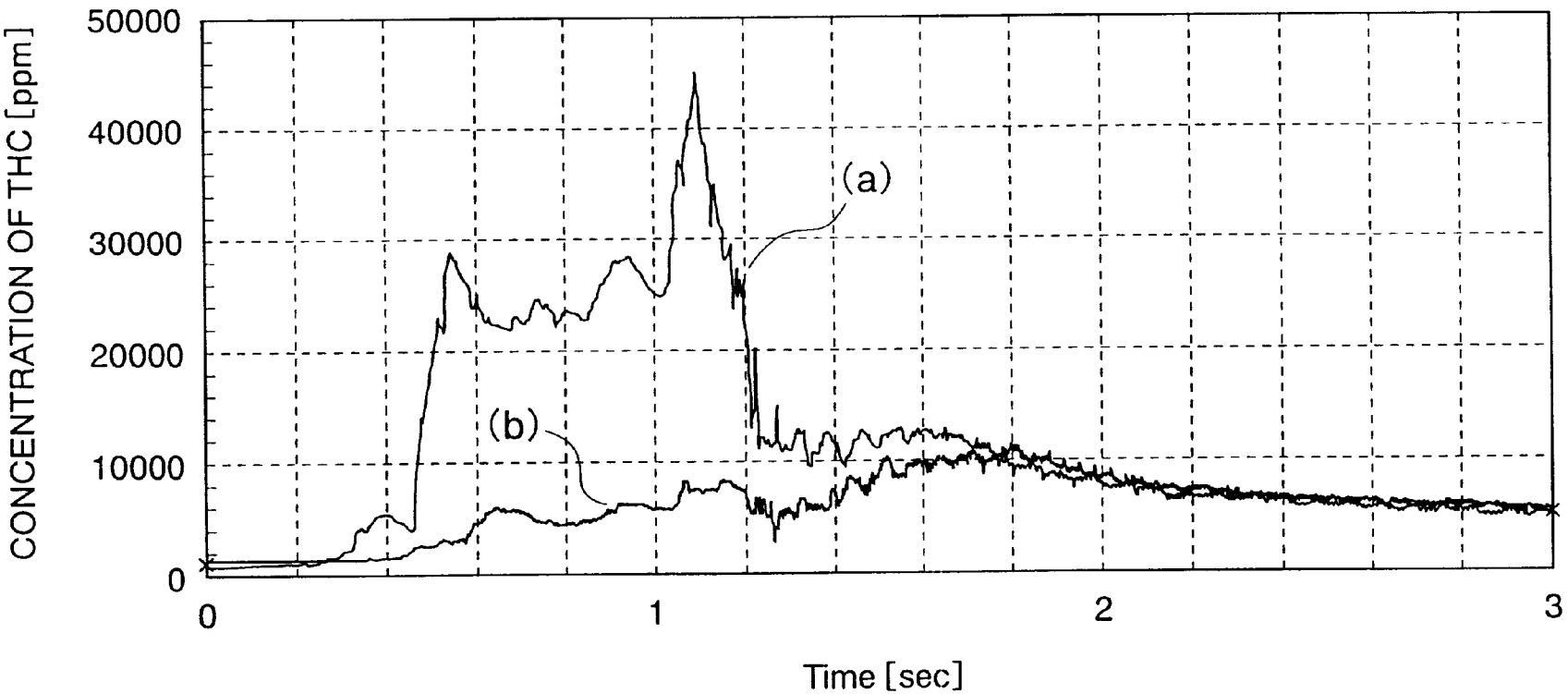
FIG. 6 is a view for graphically illustrating change of discharge quantity of hydrocarbon (HC) as a function of time lapse in the starting operation of the engine equipped with the fuel injection control apparatus according to the first embodiment of the present invention.

FIG. 5 is a view for generally illustrating change of the fuel pressure (MPa) as a function of time lapse upon stoppage of the engine, and FIG. 6 is a view for graphically illustrating change of THC concentration (i.e., concentration of total hydrocarbon or discharge quantity of hydrocarbon HC) ppm as a function of time lapse in the engine starting operation. In FIGS. 5 and 6, curves (a) represent the changes in the engine equipped with the conventional apparatus while the curves (b) represent the changes in the engine equipped with the fuel injection control apparatus according to the instant embodiment of the invention.

Referring to FIG. 5, with the fuel injection control apparatus according to the instant embodiment of the invention, the fuel pressure can sufficiently be lowered upon stoppage of the engine as represented by the curve (b) without increasing as represented by the curve (a).

Further, in the engine starting operation, the quantity of discharged hydrocarbon (HC) can sufficiently be reduced as represented by the curve (b) in FIG. 6. By contrast, in the conventional apparatus, the discharge quantity of HC increases upon starting of the engine operation, as indicated by the curve (a) in FIG. 6.

By controlling the bypass valve 25 on the basis of the estimated fuel temperature TF arithmetically determined on the basis of the intake-air temperature TA, there is no necessity of providing the fuel temperature sensor and the fuel pressure sensor. Thus, with the fuel injection control apparatus according to the first embodiment of the invention, fuel leakage from the fuel injector 8 can positively be prevented when the engine is being stopped without incurring any appreciable increase of the cost.

In this manner, the quantity of unburned hydrocarbon (HC) is reduced upon starting of the engine operation, whereby dispersion or variance of the exhaust gas components can be reduced with generation of the fuel vapor or gas being positively suppressed.

Additionally, the estimated fuel temperature TF can arithmetically be determined with high accuracy because it is based on the intake-air temperature TA.

Embodiment 2

In the foregoing description of the first embodiment of the invention, no consideration is paid to the control of the starter 16 in the engine starting operation. In a second embodiment of the present invention, a delay time which corresponds to the increase or increment of the fuel pressure is set in driving the starter 16.

In the following, description will be made of the starter delay control in the engine starting operation according to the second embodiment of the present invention by referring to FIGS. 7 and 8 together with FIG. 1 on the presumption that the starter 16 can be turned on/off directly through the control of the ECU 17.

Figure 7:
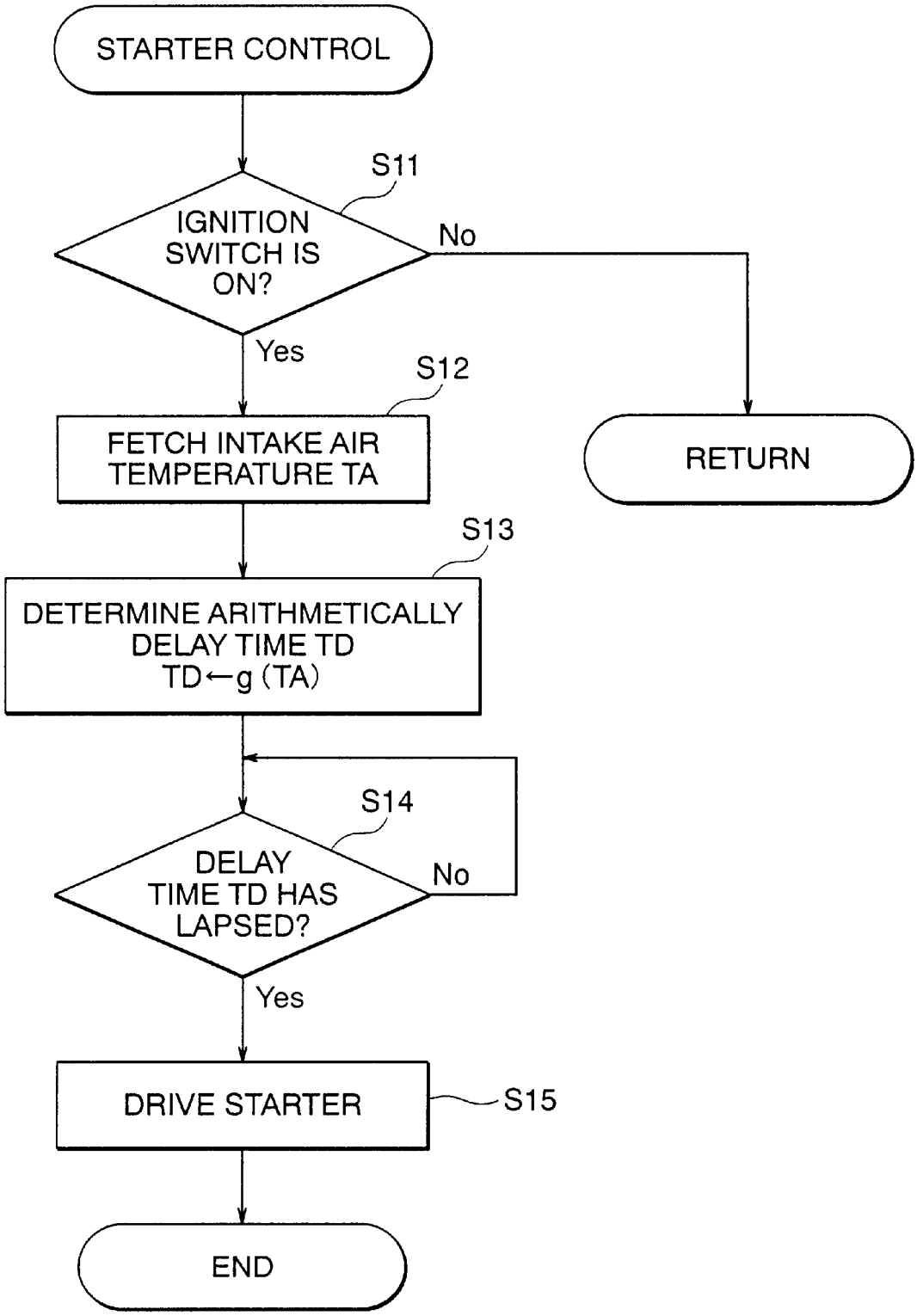
FIG. 7 is a flow chart for illustrating a starter control operation carried out by the fuel injection control apparatus according to a second embodiment of the present invention.
Figure 8:
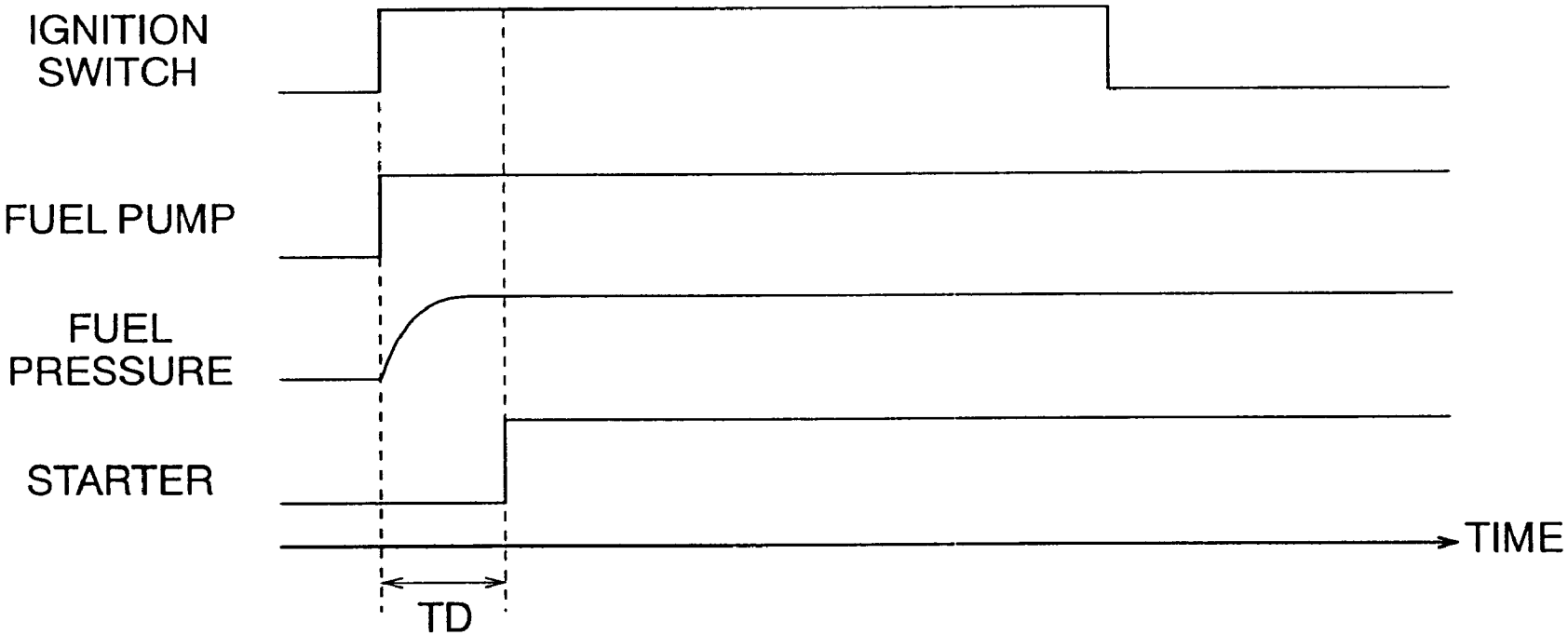
FIG. 8 is a timing chart for illustrating the starter control processing executed in the engine starting operation by the apparatus according to the second embodiment of the present invention.

FIGS. 7 and 8 show a flow chart and a timing chart, respectively, for illustrating the starter control processing in the engine starting operation according to a second embodiment of the invention.

Referring to FIG. 8, the delay time TD intervening between the closing (ON) of the ignition switch and the electrical energization or power-on of the starter 16 is set to a time required for the fuel pressure to increase sufficiently.

Next, referring to FIG. 7, the ECU 17 makes decision as to whether or not the ignition switch is "ON" (indicating the engine starting state) in a step S11. When it is decided that the ignition switch is opened or off (i.e., when the decision step S11 results in negation "NO"), execution of the processing routine illustrated in FIG. 7 is immediately terminated (RETURN).

On the contrary, when it is decided in the step S11 that the ignition switch is closed or on (i.e., when the step S11 results in affirmation "YES", then the intake-air temperature TA is fetched (step S12), whereon the delay time TD is arithmetically determined as a function g(TA) of the intake-air temperature TA in a step S13.

In that case, operation of the fuel pump 24 is started simultaneously with the closing of the ignition switch, as shown in FIG. 8, as a result of which the fuel pressure starts to increase.

Subsequently, decision is made as to whether or not the delay time TD has lapsed or not (step S14). When the delay time TD has lapsed (i.e., when the decision step S14 results in "YES"), the starter 16 is put into operation (step S15), whereupon the processing routine comes to an end.

In this manner, only when the delay time TD has lapsed, operation of the starter 16 is started.

In other words, since the fuel pressure is at a lowered level in the state where the engine operation is stopped, operation of the starter 16 for starting the engine operation is triggered after the lapse of the predetermined delay time TD from the time point at which the operation of the fuel pump 24 was started.

By virtue of the control procedure described above, the fuel injection operation of the fuel injector 8 is validated at the time point when the fuel pressure has increased up to a level where no vaporization of the fuel can occur. In this way, operation of the engine 1 can be started without fail while preventing vaporization of the fuel in the engine starting operation phase.

Many modifications and variations of the present invention are possible in the light of the above techniques. It is therefore to be understood that within the scope of the appended claims, the invention may be practiced otherwise than as specifically described.

What is claimed is:

1. A fuel injection control apparatus for an internal combustion engine, comprising:

various types of sensors for detecting operation states of an internal combustion engine;

a fuel pump and a fuel supply pipe for supplying a fuel from a fuel tank to said internal combustion engine;

a fuel injector for injecting the fuel into said engine;

engine stoppage detecting means for detecting a stopped state of said engine;

fuel temperature estimating means for estimating temperature of the fuel within said fuel supply pipe; and fuel pressure lowering means for lowering pressure of the fuel within said fuel supply pipe;

wherein said fuel pressure lowering means is so designed as to lower pressure of the fuel within said fuel supply pipe after the stoppage of operation of said engine in dependence on an estimated fuel temperature determined by said fuel temperature estimating means.

2. A fuel injection control apparatus for an internal combustion engine according to claim 1, wherein said various types of sensors includes an intake-air temperature sensor for detecting temperature of an intake air of said engine, and wherein said fuel temperature estimating means is designed to estimate the temperature of said fuel on the basis of the temperature of said intake air.

3. A fuel injection control apparatus for an internal combustion engine according to claim 1, wherein said fuel supply pipe includes a bypass valve capable of regulating the pressure of sa id fuel;

wherein said fuel pressure lowering means is so designed to compare said estimated fuel temperature with a predetermined value to thereby open said bypass valve over a predetermined time period when the value of said estimated fuel temperature is greater than said predetermined value inclusive.

4. A fuel injection control apparatus for an internal combustion engine according to claim 3, wherein said predetermined value is so set that substantially no inconvenience takes place upon restarting of operation of said internal combustion engine from a high temperature state thereof.

5. A fuel injection control apparatus for an internal combustion engine according to claim 1, wherein said engine is equipped with a starter for starting operation of the engine, further comprising:

a starter control means for controlling driving operation of said starter, wherein said starter control means is so designed as to drive said starter upon lapse of a predetermined delay time from a time point at which operation of said fuel pump has been started upon engine starting operation in a state where the fuel pressure has been lowered by said fuel pressure lowering means.

6. A fuel injection control apparatus for an internal combustion engine according to claim 5, wherein said delay time is set to a time required for the pressure of the fuel to increase sufficiently since starting of operation of said internal combustion engine.

* * * * *